US009480887B2

(12) United States Patent
Myrhum et al.

(10) Patent No.: US 9,480,887 B2
(45) Date of Patent: Nov. 1, 2016

(54) METHOD OF MANUFACTURING A STRIKING FACE OF A GOLF CLUB HEAD

(71) Applicant: Acushnet Company, Fairhaven, MA (US)

(72) Inventors: Mark C. Myrhum, Del Mar, CA (US); Uday V. Deshmukh, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 18 days.

(21) Appl. No.: 14/489,265

(22) Filed: Sep. 17, 2014

(65) Prior Publication Data

US 2015/0000367 A1 Jan. 1, 2015

Related U.S. Application Data

(62) Division of application No. 13/467,102, filed on May 9, 2012, now abandoned.

(51) Int. Cl.

| | |
|---|---|
| ***A63B 53/04*** | (2015.01) |
| ***B21D 53/00*** | (2006.01) |
| ***B21J 5/06*** | (2006.01) |

(52) U.S. Cl.

CPC ..... *A63B 53/04* (2013.01); *A63B 53/0466* (2013.01); *B21D 53/00* (2013.01); *B21J 5/06* (2013.01); *A63B 2053/0416* (2013.01); *A63B 2053/0425* (2013.01); *A63B 2053/0429* (2013.01); *A63B 2053/0445* (2013.01); *A63B 2053/0458* (2013.01); *Y10T 29/49993* (2015.01); *Y10T 29/49995* (2015.01)

(58) Field of Classification Search

CPC ..... A63B 53/04; A63B 53/047; A63B 2053/0429; A63B 2053/0416; A63B 2053/0458; B21D 53/00; B21D 22/022; Y10T 29/49995

See application file for complete search history.

(56) References Cited

U.S. PATENT DOCUMENTS

| | | | |
|---|---|---|---|
| 5,094,383 | A | 3/1992 | Anderson et al. |
| 5,282,624 | A | 2/1994 | Viste |
| 5,344,140 | A | 9/1994 | Anderson |
| 5,474,296 | A | 12/1995 | Schmidt et al. |
| 6,319,150 | B1 | 11/2001 | Werner et al. |
| 6,354,962 | B1 | 3/2002 | Galloway et al. |
| 6,381,828 | B1 | 5/2002 | Boyce et al. |
| 6,428,426 | B1 | 8/2002 | Helmstetter et al. |
| 6,508,722 | B1 | 1/2003 | McCabe et al. |

(Continued)

FOREIGN PATENT DOCUMENTS

| | | |
|---|---|---|
| JP | 3056395 | 6/2000 |
| JP | 2003210626 | 7/2003 |

(Continued)

*Primary Examiner* — Jermie Cozart

(74) *Attorney, Agent, or Firm* — Kevin N. McCoy

(57) ABSTRACT

An improved striking face of a golf club head and a method of manufacturing thereof is disclosed herein. More specifically, the present invention discloses an improved method of stamped forging variable face geometry onto the rear surface of a striking face from a frontal portion of the striking face; wherein the improved process allows for more precise finished parts with less need for complicated machining. The resulting striking face of a golf club head comprises of a substantially planar frontal surface and a substantially non-planar rear surface, wherein the substantially non-planar rear surface is created via a stamped forging process while the substantially planar frontal surface is created via a machining process.

7 Claims, 4 Drawing Sheets

(56) References Cited

U.S. PATENT DOCUMENTS

| | | | | |
|---|---|---|---|---|
| 6,524,194 | B2 | 2/2003 | McCabe | |
| 6,558,272 | B2 | 5/2003 | Helmstetter et al. | |
| 6,821,214 | B2 | 11/2004 | Rice | |
| 6,824,475 | B2 | 11/2004 | Burnett et al. | |
| 6,863,626 | B2 | 3/2005 | Evans et al. | |
| 6,966,848 | B2 * | 11/2005 | Kusumoto | A63B 53/04 473/342 |
| 6,997,820 | B2 | 2/2006 | Willett et al. | |
| 7,018,303 | B2 | 3/2006 | Yamamoto | |
| 7,131,912 | B1 | 11/2006 | Knuth | |
| 7,137,907 | B2 | 11/2006 | Gibbs et al. | |
| 7,338,388 | B2 | 3/2008 | Schweigert et al. | |
| 7,347,794 | B2 | 3/2008 | Schweigert et al. | |
| 7,448,962 | B2 | 11/2008 | Kusumoto | |
| 7,690,098 | B2 * | 4/2010 | Chen | A63B 53/0466 29/557 |
| 7,753,808 | B2 | 7/2010 | Matsunaga | |
| 8,272,975 | B2 | 9/2012 | Morin et al. | |
| 8,277,336 | B2 | 10/2012 | Hirano | |
| 8,579,728 | B2 | 11/2013 | Morales et al. | |
| 8,616,998 | B2 | 12/2013 | Cole et al. | |
| 8,715,107 | B2 | 5/2014 | Brunski | |
| 2004/0083596 | A1 * | 5/2004 | Willett | A63B 53/04 29/557 |
| 2009/0275425 | A1 * | 11/2009 | Hirano | A63B 53/0466 473/345 |
| 2010/0154196 | A1 * | 6/2010 | Hirano | A63B 53/0466 29/527.1 |
| 2013/0303305 | A1 | 11/2013 | Myrhum | |
| 2013/0344987 | A1 | 12/2013 | Takeshi | |
| 2014/0004973 | A1 | 1/2014 | Stokke et al. | |
| 2014/0011607 | A1 | 1/2014 | Stokke et al. | |
| 2014/0238092 | A1 | 8/2014 | Li et al. | |

FOREIGN PATENT DOCUMENTS

| | | |
|---|---|---|
| JP | 2008035963 | 2/2008 |
| JP | 5243490 | 7/2013 |

* cited by examiner

METHOD OF MANUFACTURING A STRIKING FACE OF A GOLF CLUB HEAD

CROSS-REFERENCE TO RELATED APPLICATIONS

The present application is a divisional of U.S. patent application Ser. No. 13/467,102, to Myrhum et al., Striking Face of a Golf Club Head and a Method of Manufacturing the same, filed on Jun. May 9, 2012, currently pending, the disclosure of which is hereby incorporated by reference in its entirety.

FIELD OF THE INVENTION

The present invention relates to a striking face of a golf club head and a method of manufacturing the same. More specifically, the present invention relates to an improved method of stamped forging variable face geometry onto the rear surface of a striking face from a frontal portion of the striking face; wherein the improved process allows for more precise finished parts with less need for complicated machining. The resulting striking face of a golf club head comprises of a substantially planar frontal surface and a substantially non-planar rear surface, wherein the substantially non-planar rear surface is created via a stamped forging process while the substantially planar frontal surface is created via a machining process.

BACKGROUND OF THE INVENTION

Ever since the metalwood golf club burst onto the scene to replace the traditional persimmon wood, golf club designers have constantly sought to find ways to improve upon this groundbreaking design.

U.S. Pat. No. 5,474,296 to Schmidt et al. illustrate one of the earlier attempts to improve upon the design opportunity created by a hollow metalwood golf club by disclosing a golf club with a variable faceplate thickness. One way a variable faceplate thickness improves the performance of a metalwood club is by reducing the amount of weight at low stress areas of the striking faceplate to create more discretionary weight that can be placed at alternative locations in the golf club head to improve the performance of the golf club head. In addition to the above benefit, the incorporation of variable faceplate thickness can also improve upon the performance of the golf club head by adjusting the coefficient of restitution of the striking face.

U.S. Pat. No. 6,863,626 to Evans et al. illustrates this secondary benefit of adjusting the coefficient of restitution of a golf club by disclosing a golf club having a striking plate with regions of varying thickness. More specifically, U.S. Pat. No. 6,863,626 identifies this benefit by indicating that striking plate having regions of varying thickness allows for more compliance during impact with a golf ball, which in turn, could generate more ballspeed.

U.S. Pat. No. 7,137,907 to Gibbs et al. illustrates the ability to further improve upon the design of a striking face having a variable face thickness for a purpose that is different from saving weight and improving coefficient of restitution. More specifically, U.S. Pat. No. 7,137,907 illustrates a way to expand upon the "sweet spot" of a golf club head in order to conform to the rules of golf that puts a cap on the maximum coefficient of restitution allowed by a golf club. U.S. Pat. No. 7,137,907 does this by disclosing a golf club face or face insert wherein the face has an interior surface with a first thickness section and a second thickness region. The first thickness section preferably has a thickness that is at least 0.025 inch greater than the thickness of the second thickness region. The face or face insert with variable thickness allows for a face or face insert with less mass in a golf club head that conforms to the United States Golf Association regulations.

With the incorporation of variable face thickness into hollow metalwood type golf club heads, various methodologies of manufacturing have been developed to create this complicated geometry. U.S. Pat. No. 6,354,962 to Galloway et al. illustrates one methodology to create a striking wherein the face member is composed of a single piece of metal, and is preferably composed of a forged metal material, more preferably a forged titanium material. However, due to the need for precise geometry, the variable face geometry created by this conventional forging process may often exhibit waviness which will often need to be machined to the exact precise geometry. U.S. Pat. No. 7,338,388 to Schweigert et al. discusses this machining process by utilizing a ball end mill revolving about an axis generally normal to the inner surface of the face plate at an initial location on a circumferential intersection between the outer edge of the central thickened region and a transition region. The inner surface of the face plate is machined by moving the revolving ball end mill in a radial direction outwardly toward and through the transition region and the peripheral region to machine the inner surface of the face plate creating a tool channel having a width as the ball end mill traverses the transition region and thereby vary the thickness of the face plate in the tool path.

Although the machining process described above may be capable of creating a very precise geometry, the resulting striking face could still be flawed due to some inherent machining side effects. Undesirable side effects such as the existence of machine marks, circular cutting patterns, discontinuity of machine lines, starting and stopping marks, and/or machine chatters could all adversely affect the striking face.

U.S. Pat. No. 6,966,848 to Kusumoto attempts to address this issue of trying to create an improved striking face of a golf club head by disclosing a methodology wherein the stamped out face material is placed in a die assembly, wherein the face material is being thinned by causing the face material to plastically deform via pressing an upper die together with the lower die. Although this particular type of conventional forging methodology eliminates the adverse side effects of machining above described, it suffers from an entirely different set of adverse side effect. More specifically, the conventional forging of a face insert suffers from lack of material consistency and material transformation that results when a material is melted and plastically deformed resulting in grain growth and oxidation; both of which can lower the material strength of a material.

In addition to the above flaws in the current manufacturing techniques, these flaws of the current techniques become even more apparent when a designer seeks to further advance the performance of a striking face by implementing non-symmetrical geometries that would either require extensive machining, or extreme sacrifice in material property depending on the solution selected.

Hence, as it can be seen from above, despite all the attempts in addressing the consistency and accuracy issue in creating the variable face geometry in a golf club head striking face, the current art falls short in providing a methodology that can address the issues above. Ultimately, it can be seen from above that there is a need in the art for a methodology of creating the striking face portion of a golf club head with variable face geometry without relying on material conventional property changing forging techniques or simple machining techniques to ensure more precision and consistency for basic symmetrical geometries and even extreme asymmetrical geometries.

BRIEF SUMMARY OF THE INVENTION

One aspect of the present invention is a striking face of a golf club head comprising of a substantially planar frontal surface, and a substantially non-planar rear surface, wherein the substantially planar frontal surface and the substantially non-planar rear surface combine to create a central region having a first thickness encompassing a geometric center of said striking face, a transition region circumferentially encompassing said central region, and a perimeter region circumferentially encompassing said transition region. The substantially non-planar rear surface is created via a stamped forging process and the substantially planar frontal surface is created via a machining process.

Another aspect of the present invention is a method of forming a striking face of a golf club head comprising of placing a pre-form face insert between a top punch and a bottom cavity; the top punch having a protrusion and the bottom cavity having a depression, compressing the top punch against the bottom cavity to alter a shape of the pre-form face insert to create a substantially non-planar rear surface, and machining off excess material from a top punch side of the pre-form face insert to create a substantially planar frontal surface. The substantially non-planar rear surface of the pre-from face insert has a non-symmetrical shape about its vertical dividing line, the vertical dividing line defined as a line drawn vertically through the crown and sole portion of the face insert passing through a face center.

A further aspect of the present invention is a method of forming a striking face of a golf club head comprising of placing a pre-form face insert between a top punch and a bottom cavity; the top punch having a protrusion and the bottom cavity having a depression, compressing the top punch against the bottom cavity to alter a shape of the pre-form face insert to create a substantially non-planar rear surface, and filling the rear indentation of the pre-form face insert that is created by the protrusion of the top punch with a secondary material, wherein the secondary material is a different material than a material used for the pre-form face insert.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
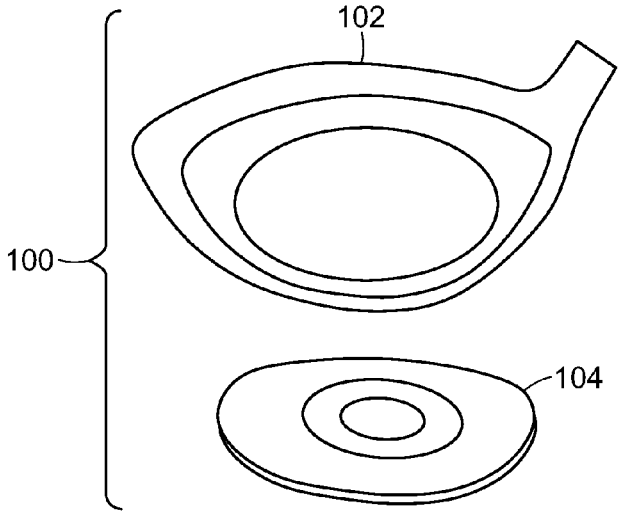
FIG. 1 shows a perspective view of a golf club head that is disassembled in accordance with an exemplary embodiment of the present invention.

FIG. 1 of the accompanying drawings shows a perspective view of a golf club head 100 wherein a body portion 102 and a face insert 104 are disassembled to show the variable face thickness at a rear portion of the face insert 104. It should be noted in FIG. 1 the golf club head has the face insert 104 forming the striking face portion of the golf club head 100 as one of the exemplary embodiments. However, a face insert 104 type geometry is not the only way to form the striking face portion, in fact numerous other geometries can be used to form the striking face portion such as a C shaped face cup, a L shaped face cup, a T shaped face cup, or any other suitable geometry all without departing from the scope and content of the present invention.

Figure 2:
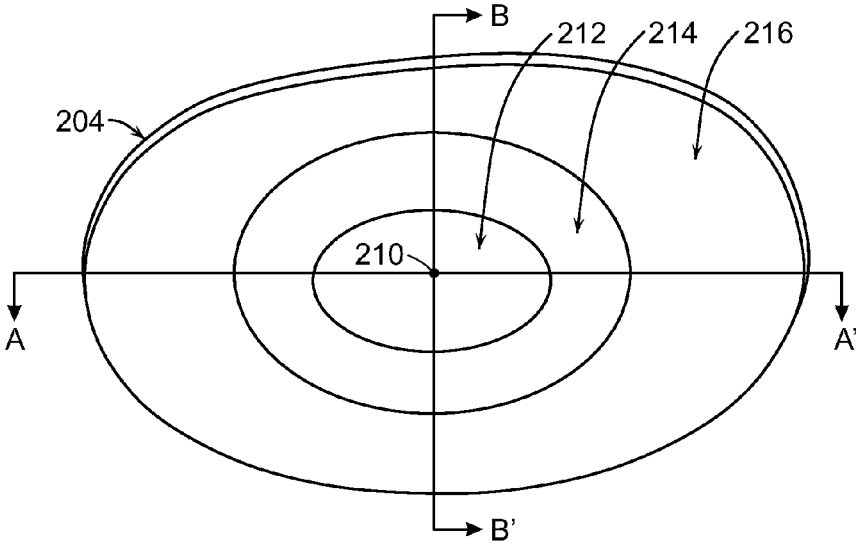
FIG. 2 shows an internal rear view of a face insert in accordance with an exemplary embodiment of the present invention.

FIG. 2 of the accompanying drawings shows a more detailed enlarged perspective view of a face insert 204 in accordance with an exemplary embodiment of the present invention. More specifically, the internal back view of the face insert 204 allows the face center 210, central region 212, transition region 214, and the perimeter region 216 to all be easily shown. In addition to showing the various regions, FIG. 2 of the accompanying drawings shows a cross-sectional line A-A' horizontally dividing the face insert 204 to illustrate the relative thicknesses of the various regions in FIG. 3. This cross-sectional line A-A' may also be known as the horizontal dividing line, spanning horizontally through the heel and toe portion of said face insert passing through a face center 210. FIG. 2 also shows a vertical dividing line B-B', that spans vertically through the crown and sole portion of said face insert passing through a face center 210.

Figure 3:
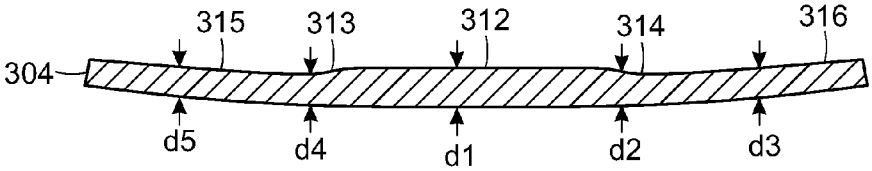
FIG. 3 shows a cross-sectional view of a face insert in accordance with an exemplary embodiment of the present invention.

FIG. 3 of the accompanying drawings shows a cross-sectional view of the face insert 304 taken across cross-sectional line A-A' as shown in FIG. 2. It should be noted that FIG. 3 of the present invention shows a central region 312 having a first thickness d1, a first transition region 314 having a second thickness d2, a first perimeter region 316 having a third thickness d3, a second transition region 313 having a fourth thickness d4, and a second perimeter region 315 having a fifth thickness d5. In one exemplary embodiment, wherein the geometry of the variable face thickness is symmetrical, the thickness of the first and second transition regions 313 and 314 are the same and the thickness of the first and second perimeter region 315 and 316 are the same. It should be noted that due to the fact that the transition regions 313 and 314 are constantly transitioning in thickness from the central region 312 to the perimeter regions 315 and 316, the thickness of the transition regions 313 and 314 are measured at the center of the transition regions 313 and 314. In some instances it is preferred to have symmetry in the variable face thickness geometry, as it makes for fairly simple and straight forward machining. However, the symmetrical geometry may not truly optimize the weight and performance characteristics of a striking face, and has generally stemmed from the machining problems that can come with asymmetrical geometries.

Hence, in accordance with an alternative and preferred embodiment of the present invention, the face insert 304 may have an asymmetrical geometry. More specifically, the first transition region 314 may have a second thickness d2 that is different from the fourth thickness d4 of the second transition region 313, and the first perimeter region 316 may have a third thickness d3 that is different from the fifth thickness d5 of the second perimeter region 315. Removing the restriction of symmetrical variable face thickness geometry removes unnecessary design restrictions to allow a golf club designer to truly optimize the face design. In fact, the preference for symmetrical face geometries in a face insert has always been driven by manufacturing preferences. In one exemplary embodiment, a golf club designer could further thin out different regions of the striking face that is not subjected to the highest level of stress, creating more discretionary mass to be moved to different regions of the golf club head itself.

In this exemplary embodiment, thickness dl of the central region 312 may generally be greater than about 3.0 mm, more preferably greater than about 3.30 mm, and most preferably greater than about 3.60 mm. Thickness d2 and d4 of the transition regions 314 and 313 respectively may generally decrease from about 3.60 mm to about 2.7 mm, more preferably from about 3.60 mm to about 2.65 mm, and most preferably from about 3.60 mm to about 2.60 mm. Finally, thickness d3 and d5 of perimeter regions 316 and 315 respectively may generally also be decreasing from about 2.70 mm to about 2.55 mm, more preferably from about 2.65 mm to about 2.50 mm, and most preferably from about 2.60 mm to about 2.45 mm.

Based on the above, it can be seen that a new methodology needs to be created to effectively create this constantly changing face thickness without the need to machine complicated geometry that is asymmetrical. The current invention, in order to achieve this goal has created an innovative machining process detailed in FIGS. 4*a*, 4*b*, 4*c*, 5*a*, 5*b*, and 5*c* shown in the later figures.

Figure 4A:
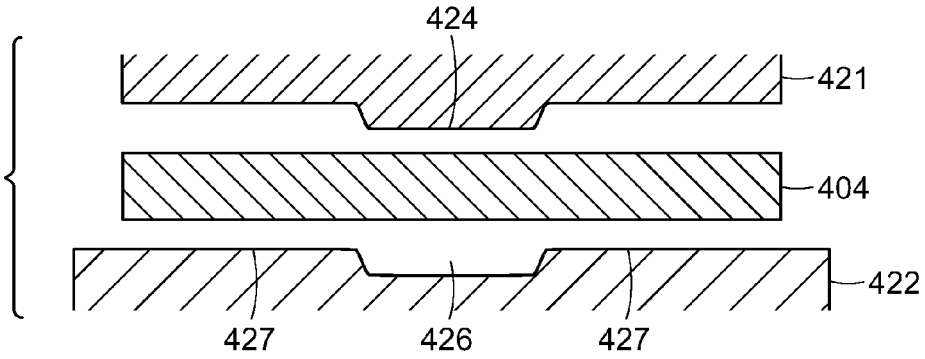
FIG. 4*a* shows a side view of one of the steps used to create a face insert in accordance with an exemplary embodiment of the present invention.
Figure 4B:
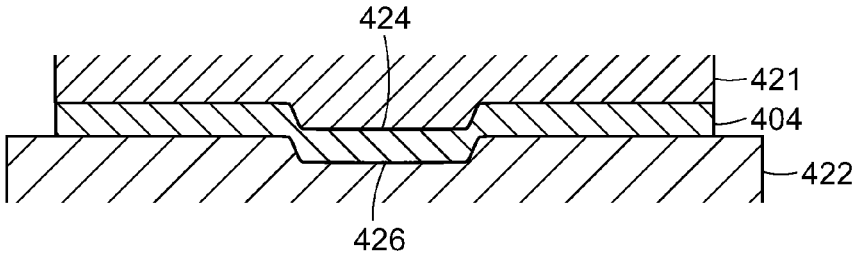
FIG. 4*b* shows a side view of one of the steps used to create a face insert in accordance with an exemplary embodiment of the present invention.
Figure 4C:
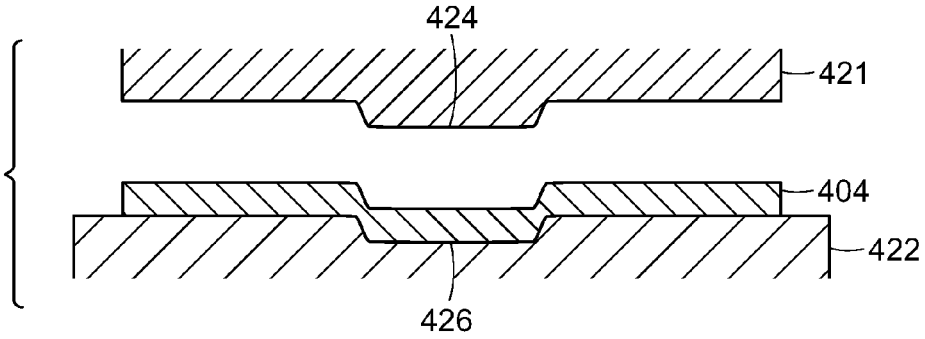
FIG. 4*c* shows a side view of one of the steps used to create a face insert in accordance with an exemplary embodiment of the present invention.

FIG. 4*a* through FIG. 4*c* illustrates graphical depiction of the new innovative face insert forming technique associated with an exemplary embodiment of the present invention called "stamped forging". Although this new innovative forming technique may have some similarities to the conventional forging process, it is completely different. In fact, the conventional forging process involves deformation of the face insert 404 pre-form material to create the material flow into a cavity. This melting of the material is undesirable when used to form the striking face portion of the golf club head, as the melting of the material, combined with the phase transformation of the material, could result in grain growth and oxidation of the titanium material, both of which diminishes the material strength of titanium.

The current process is completely different from the conventional forging process because it involves the elements of stamping as well as forging, and can be more accurately described as "stamped forging" or "embossed forging". During this "stamped forging" or "embossed forging" process the face-insert 404 pre-form does not experience any phase transformation, but is merely warmed to a malleable temperature to allow deformation without the actual melting of the face insert 404 pre-form.

More specifically, in FIG. 4*a*, a side view of the first step in the current forming technique is shown. In FIG. 4*a*, the various components used for the formation of the face insert 404 such as the top punch 421 and bottom cavity 422 are shown in more detail. More specifically, as it can be seen from FIG. 4*a*, the top punch 421 has a protrusion 424 created in roughly the shape of the desired variable face thickness geometry; while the bottom cavity 422 has a corresponding depression 426 that also roughly corresponds to the shape of the desired variable face thickness geometry. Although not shown in extreme detail, FIG. 4*a* shows that the bottom cavity 422 could be non-linear along the perimeter edges 427 to create a constantly variable thickness across the entire perimeter surface of the face insert 404 pre-form.

FIG. 4*b* shows the next step of the current inventive stamped forging methodology wherein the top punch 421 compresses against the bottom cavity 422 to alter the shape and geometry of the face insert 404. Although the current inventive methodology does not involve the melting of the material used to create the face insert 404, the face insert 404 is generally heated up to about 830° C. for about 300 seconds on a conveyor belt to increase the malleability of the face insert 404 to allow for the deformation. In this current exemplary embodiment of the invention the top punch 421 generally applies about 100 MPa of pressure onto the face insert 404 for about 2 seconds to create the desired geometry.

FIG. 4*c* shows the next step of the current inventive stamped forging methodology wherein the shape of the variable face thickness geometry begins to take place when the top punch 421 is removed from the bottom cavity 422. It should be noted here that in this current exemplary embodiment of the present invention, the side of the face insert 404 that faces the top punch 421 will eventually form the external surface of the face insert 404 as it gets assembled in the golf club head, while the side of the face insert 404 that contacts the bottom cavity 422 will eventually form the internal surface of the face insert 404 as it gets assembled in the golf club head. This type of methodology ensures that a precise geometry could be achieved on the internal side of the face insert 404 without the need for excessive machining, even if a non-symmetrical organic shape is desired to maximize the performance of the face insert 404.

Although the steps described above in FIGS. 4*a* through 4*c* may be sufficient to create the desired geometry in some circumstances, additional steps similar to the ones described above may be repeated to achieve more precise and complicated geometries. In the alternative embodiments wherein multiple stamped forging steps are required, the process could be repeated for rough and fine stamped forging without departing from the scope and content of the present invention. In fact, the steps described could be repeated three time, four times, or any number of times necessary to achieve the desired geometry all without departing from the scope and content of the present invention. In cases wherein multiple stamped forging steps are needed, the shape and geometry of the top punch 421 and the bottom cavity 422 may even be slightly different from one another, with each finer mold having a closer resemblance to the final finished geometry.

Figure 5A:
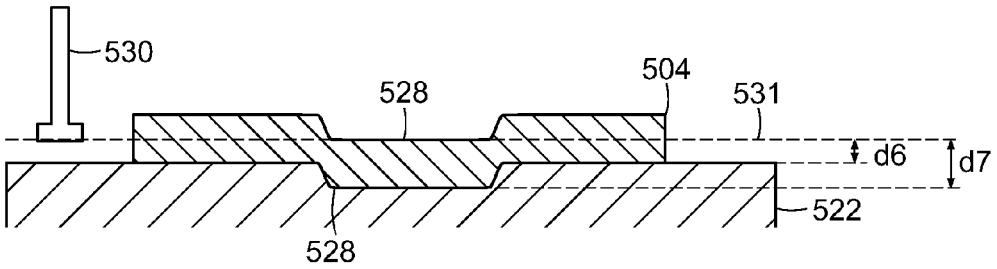
FIG. 5*a* shows a side view of one of the steps used to create a face insert in accordance with an exemplary embodiment of the present invention.
Figure 5B:
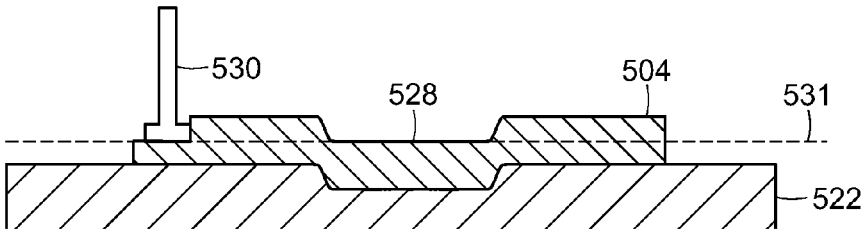
FIG. 5*b* shows a side view of one of the steps used to create a face insert in accordance with an exemplary embodiment of the present invention.
Figure 5C:
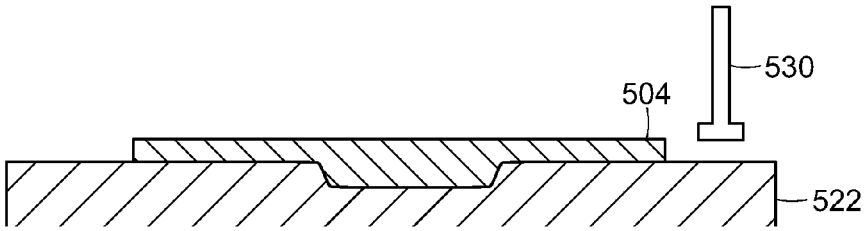
FIG. 5*c* shows a side view of one of the steps used to create a face insert in accordance with an exemplary embodiment of the present invention.

Once the geometry of the internal surface of the face insert 404 is formed via the above prescribed methodology, the external surface of the face insert 404 can be machined off a flat geometry, which is a significant improvement than the conventional methodology of actually machining in the complicated geometry on the rear internal surface of the face insert 404. FIGS. 5*a* through 5*c* illustrate the final steps involved in machining off the excess material in this the current face insert 504 stamped forging methodology.

FIGS. 5*a*-5*c* show side views of a face insert 504 together with the bottom cavity 522 after the top punch (not shown) has created the desired geometry by deforming the shape of the face insert 504 in the previous steps. In these final steps, the excess material of the face insert 504 is removed via a cutter 530. The excess material, as shown in this current exemplary embodiment of the present invention, may generally be defined as any material that is above the cutting line 531 shown in FIG. 5*a*. This cutting line 531 is generally defined by the flat surface that significantly aligns with the bottom of the rear indentation 528 of the formed face insert 504. In fact, in most exemplary embodiments, the cutting line 531 may actually be placed slightly below the bottom of the rear indentation 528 of the formed face insert 504 to allow for a precise finish of the face insert 504.

The position of this cutting line 531 can be important, as it determines the relative thickness of the face insert 504. Hence, in order to more accurately define this cutting line 531, distance d6 and d7 are identified in FIG. 5*a*. Here, in this current exemplary embodiment distance d6 signifies the distance of the final thickness of the perimeter relative to the perimeter surface of the bottom cavity 522. This distance d6 may generally vary from about 2.2 mm to about 2.6 mm, more preferably from about 2.3 mm to about 2.6 mm, and most preferably from about 2.4 mm to about 2.6 mm. However, as it has already been discussed before the perimeter region of the face insert 504 could very well have a variable thickness, thus making it difficult to determine the thickness of d6; as the thickness d6 would be a function of the perimeter of the face insert 504. Thus, in order to properly index the cutter 530 to remove the correct amount of material from the frontal surface of the striking face 504, an additional thickness d7 is identified; measuring the distance from the bottom of the depression 526 of the bottom cavity 522 to the cutting line 531 from which the removal of material is indexed. Distance d7, as it is shown in this current exemplary embodiment of the present invention, may generally be between about 3.5 mm to about 3.8 mm, more preferably between about 3.6 mm to about 3.7 mm, and most preferably about 3.65 mm.

The cutter 530 shown in this current exemplary embodiment of the present invention may generally be a fly cutter type cutter to ensure a smooth surface that will eventually form the frontal surface of a golf club head, however, numerous other types of cutters may be used without departing from the scope and content of the present invention. More specifically, alternative cutters 530 may include an end mill clutter, a ball nose cutter, a side and face cutter, a woodruff cutter, a shell mill cutter, or any type of milling cutter all without departing from the scope and content of the present invention. In fact, the finished surface could even potentially be achieved by any alternative finishing techniques that could create a flat surface all without departing from the scope and content of the present invention.

FIG. 5*b* shows an intermediary stage of the cutting process wherein the cutter 530 begins to remove excess material from the formed face insert 504 along cutting line 531. Finally, FIG. 5*c* shows the finished product of a face insert 504 in accordance with an exemplary embodiment of the present invention wherein the excess material has been removed by the cutter 530. The finished face insert 504 can then be bent to the required curvature to match the bulge and roll of a golf club head and installed to complete the golf club head. As it can be seen from above, the innovative forming and finishing method is a major improvement in simplifying the machining process involved to a simple one pass finish, especially when compared to the conventional method of machining the actual variable thickness geometry. This advantage of not having to machine the actual geometry becomes even more apparent when the variable geometry implemented involves non-symmetrical shapes, as those types of geometries become extremely difficult to machine using conventional machining methods.

Figure 6A:
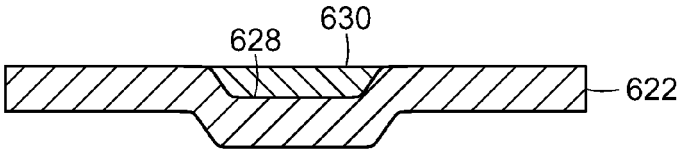
FIG. 6*a* shows a cross-sectional view of a face insert in accordance with an alternative embodiment of the present invention.
Figure 6B:
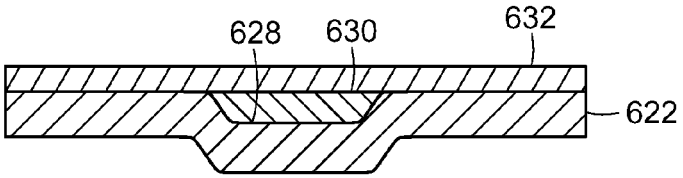
FIG. 6*b* shows a cross-sectional view of a face insert in accordance with a further alternative embodiment of the present invention.

FIGS. 6*a* and 6*b* show alternative embodiments of the present invention wherein the frontal indentation 628 of the striking face insert 622 are preserved and not machined off. In these embodiments, the frontal indentation 628 could be filled with a secondary material that is different from the material used to create the face insert 622 to create a striking face insert 622 that incorporates multiple materials. The filler 630 in this current exemplary embodiment could be made out of steel, aluminum, tungsten, composites, or any other types of material that can be reasonably adhered to the rear indentation 628 of the face insert 622 without departing from the scope and content of the present invention. The filler 630 material may have a have a second density greater than a density of the material used to create the face insert 622 in one exemplary embodiment of the present invention; however, in an alternative embodiment of the present invention, the filler 630 material may also have a second density that is less than the density of the material used to create the face insert 622 without departing from the scope and content of the present invention. In an alternative embodiment, the frontal indentation 628 could be filled with a filler 630 that is made out of a similar type material as the remainder of the face insert 622 to ensure sufficient bonding and cohesion between the materials. More specifically, in this alternative embodiment, the filler 630 material could be Ti-64, Ti-811, SP-700, ATI-425, or any other type of titanium alloys all without departing from the scope and content of the present invention.

FIG. 6*b* shows a further alternative embodiment of the present invention wherein the external surface of the face insert 622 could be covered with a cover layer 632 to ensure that the entire external surface of the face insert 622 has the same material to conform with the requirements of the USGA. In one exemplary embodiment of the present invention the cover layer 632 may be made out of titanium type material similar to the remainder of the body; however, different types of titanium alloys could be used without departing from the scope and content of the present invention as long as it is capable of covering the external surface of the face insert 622.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A method of forming a striking face of a golf club head comprising:

placing a pre-form face insert between a top punch and a bottom cavity; said top punch having a protrusion and said bottom cavity having a depression, compressing said top punch against said bottom cavity to alter a shape of said pre-form face insert to create a substantially non-planar rear surface; and machining off excess material from a top punch side of said pre-form face insert to create a substantially planar frontal surface;

wherein said substantially non-planar rear surface of said pre-form face insert has a non-symmetrical shape about its vertical dividing line, said vertical dividing line defined as a line drawn vertically through the crown and sole portion of said face insert passing through a face center.

2. The method of forming the striking face of a golf club head of claim 1, further comprising: heating said pre-form face insert to a temperature of about 830° C. before placing said pre-form face insert between said top punch and said bottom cavity.

3. The method of forming the striking face of a golf club head of claim 2, wherein said step of heating said pre-form insert to about 830° C. lasts for about 300 seconds.

4. The method of forming a striking face of a golf club head of claim 1, wherein said step of compressing said top punch against said bottom cavity applies about 100 MPa of pressure onto said pre-form face insert.

5. The method of forming a striking face of a golf club head of claim 1, wherein the step of machining off the excess material further comprises:

indexing a distance from a bottom surface of said depression of said bottom cavity, machining off any excess material that is thicker than said distance from said bottom surface of said depression of said bottom cavity;

wherein said distance is between about 3.5 mm to about 3.8 mm.

6. The method of forming a striking face of a golf club head of claim 5, wherein said distance is between about 3.6 mm to about 3.7 mm.

7. The method of forming a striking face of a golf club head of claim 6, wherein said distance is about 3.65 mm.

* * * * *